US005836793A

United States Patent [19]

Chaillot et al.

[11] Patent Number: 5,836,793

[45] Date of Patent: Nov. 17, 1998

[54] FEMALE ELECTRICAL CONTACT TERMINAL OF THE REINFORCED-CAGE TYPE

[75] Inventors: Georges Chaillot, Nogent le Roi; Patrice Cappe, Faverolles, both of France

[73] Assignee: Framatome Connectors International, Courbevoie, France

[21] Appl. No.: 864,695

[22] Filed: May 28, 1997

[30] Foreign Application Priority Data

Jun. 3, 1996 [FR] France ..... 96/06785

[51] Int. Cl.[6] ..... H01R 11/22

[52] U.S. Cl. ..... 439/852; 439/595

[58] Field of Search ..... 439/850, 851, 439/852, 853, 595, 744

[56] References Cited

U.S. PATENT DOCUMENTS 4,834,681 5/1989 Chaillot ..... 439/856
5,478,263 12/1995 Kato ..... 439/752
5,607,328 3/1997 Joly ..... 439/851

FOREIGN PATENT DOCUMENTS 0 189 359 A1 7/1986 European Pat. Off. .
0 310 487 A1 4/1989 European Pat. Off. .
0697752 2/1996 European Pat. Off. .
2 627 020 A1 8/1989 France .

*Primary Examiner*—Neil Abrams
*Assistant Examiner*—Barry M. L. Standig
*Attorney, Agent, or Firm*—Pollock, Vande Sande & Priddy

[57] ABSTRACT

Female electrical contact terminal obtained from a single electrically conducting metal sheet having a rear part enabling it to be connected to an electrical conductor and a front part in the form of a cage consisting of an end, of two upper half-walls, of two side walls, which are provided with an arrangement for guiding a male contact during its insertion and with an arrangement for fixing this cage in connection housings and having a window in each side wall, a projection carried by a finger provided in the insulator of the connection housing, and a deformation defining a shoulder which bears on the bearing surface of the projection.

6 Claims, 4 Drawing Sheets

FEMALE ELECTRICAL CONTACT TERMINAL OF THE REINFORCED-CAGE TYPE

FIELD OF THE INVENTION

The present invention relates to a one-piece female electrical contact terminal, made of cut and formed sheet metal, intended to receive a male contact. It relates more particularly to a terminal of the type comprising a front body in the form of a cage having an end, an upper wall and two side walls each having an internal tab which is joined to them by a 180°-fold and which at the front has a cantilevered part constituting a contact blade.

BACKGROUND OF THE INVENTION

Contact terminals of the type defined above are already known, these being able to be manufactured by cutting, folding, forming and possibly rolling of a sheet of metal strip much more economically than lathe-cut terminals. On the other hand, existing contacts made of cut and formed sheet metal have a number of drawbacks. If the contact blades initially bear against each other and require a high force to separate them, which is conducive to establishing a high contact pressure guaranteeing an electrical connection of good quality, the insertion force is high and there is a risk that introduction is difficult. This first drawback may become serious if a large number of contact terminals are provided in the same connector. If on the other hand the contact blades are initially separated, the pressure exerted by each contact blade may in some cases be insufficient to ensure good electrical connection.

One solution to this technical problem has been provided in FR-A-2,621,180 which describes a female contact terminal which simultaneously guarantees satisfactory electrical connection and provides guidance of the male contact while it is being introduced. Thus each side wall has, at the front, a flap folded over inwards, retaining the flexurally prestressed contact blade in a position in which it is not in contact with the other contact blade.

At the present time, many contact terminals made of folded sheet metal furthermore run the risk of being crushed while they are being handled in production or at the premises of harness manufacturers. This is particularly the case with female electrical contact terminals in the form of a cage, but having a single wall, such as those described in U.S. Pat. No. 4,453,799 or EP-A-0,697,752, or else with those having contact blades which are not prestressed and do not contribute to the stiffness of the cage as are described, for example, in FR-A-2,627,020.

Single- or double-wall electrical terminals must moreover withstand any pull-out action or shearing action of the metal strip of which they are made. Thus, because of the cutting-out, forming and bending operations performed on these thin metal sheets, the intersections of the lines of cutting may shear and tear due to a lateral mechanical thrust being exerted on a wall or parallel thereto.

This risk is particularly high in the thinned regions, such as the transition region between the rear part for connection to an electrical wire and the front part formed by the cage, or else in the windows of the cage which are provided for fixing the terminal in plastic housings of the connectors receiving these terminals.

Finally, mention should be made of the risk of the forcible introduction of a male contact whose dimensions are greater than the internal dimensions of the cage, which contact would consequently apply a pressure, on the contact blades, greater than the pressure of the elastic deformation limit of the metal of which the contact blade is made, which would lead to eventual deterioration of the blade having then reached its plastic deformation limit.

These drawbacks become particularly important when, for economic requirements, the manufacturers, seeking solutions intended to reduce costs without impairing quality, envisage reducing the thickness of the metal strip of which the single electrically conducting metal sheet is made.

SUMMARY OF THE INVENTION

The invention thus aims to provide a female electrical contact terminal obtained from a single electrically conducting metal sheet having a rear part enabling it to be connected to an electrical conductor and a front part in the form of a cage consisting of an end, of two upper half-walls, of two side walls, which are provided with means for guiding a male contact during its insertion and with means for fixing this cage in connection housings, these fixing means having, inter alia, a window made in each side wall, a projection carried by a finger provided in the insulator of the connection housing.

According to the invention, at least one of the edges of the opening has a deformation defining a shoulder whose bearing surface area is substantially greater than the bearing surface area of the projection.

According to a first embodiment, the deformation has a fold oriented towards the inside of the terminal.

According to a second embodiment, the deformation has a double fold oriented in a first direction towards the inside of the terminal and then oriented at 180° from the first direction.

According to another characteristic of the invention, the plane of the bearing surface defines with the plane perpendicular to the longitudinal axis of the terminal an angle $\alpha$ of between 1° and 45° and preferably having a value of 15°.

BRIEF DESCRIPTION OF THE DRAWINGS

The invention will be more clearly understood on reading the description which follows of a particular embodiment of the invention, given by way of example. The description refers to the drawings which accompany it, in which.

DESCRIPTION OF PREFERRED EMBODIMENT

Figure 1:
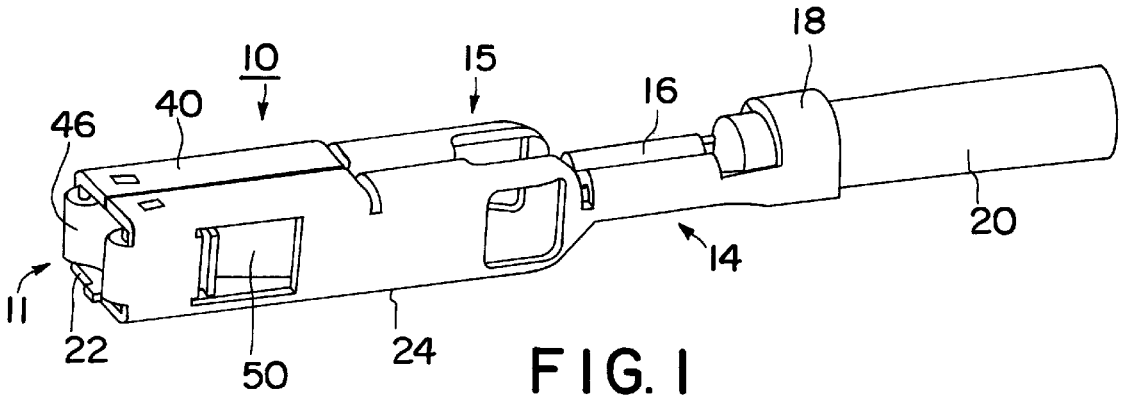
FIG. 1 is a perspective view showing a female electrical contact terminal according to the invention.
Figure 2:
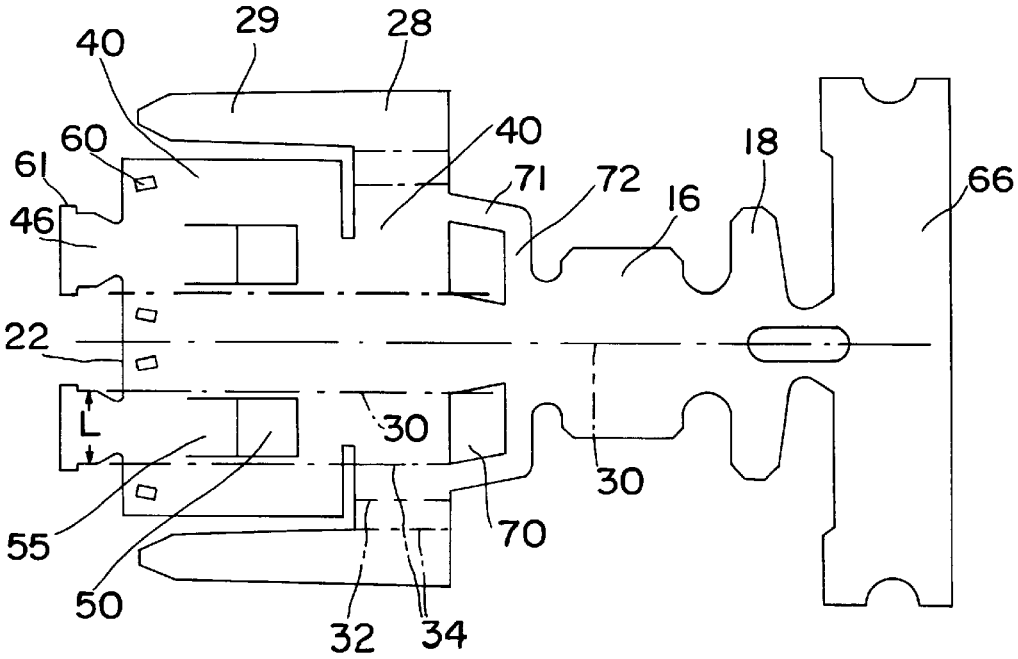
FIG. 2 is a plan view of a sheet intended to be folded, in order to make the terminal of the invention.

The terminal whose final construction is shown in FIGS. 1 and 3 to 6, produced from a sheet of the kind shown in FIG. 2, is intended to be inserted into a connector housing whose general construction may be conventional. The terminal 10 is made of a single piece, and may be regarded as having a front body 11 intended to receive a male contact 12 and a rear part or stem 14 to be crimped. These two parts are separated by a transition region 15. The stem 14 has two sets of tabs 16 and 18, respectively intended to be crimped onto the core and onto the sheath of an electrical wire 20.

The body of the terminal 10 is in the form of a cage having an end 22 and two sides 24. Each side 24 is double. It comprises an external wall 26 and an internal tab 28. Each external wall 26 is produced by folding the original sheet at 90° along one of the lines 30 indicated by the dot-dash lines in FIG. 2. The internal tab 28 is connected to the external wall 26 by a 180°-fold along the edge indicated at 32 in FIG. 2. The two together, wall 26 and tab 28, make a right-angled fold along the lines denoted by 34 in FIG. 2.

As may be seen in FIG. 2, each internal tab 28 is joined to the corresponding external wall 26 only in its rear part. The front part of each internal tab 28 thus forms an elastic bearing contact blade 29 which generates a pressure on the surface of the male contact 12 when the latter is inserted.

In another embodiment, not shown, each contact blade 29 could be divided by a slit over part of its length starting from the free end, which allows more uniform bearing; however, this division is not absolutely necessary. One of the contacts (or both of them) could have no slit. Conversely, it will be possible to provide more than one slit in each contact blade.

Between the wall 26 and the tab 28 a wall part close to the 180°-fold forms a half-ceiling of the cage. In the embodiment shown, the cutting of the original sheet leaves tabs 40 which bear in abutment one against the other and form a continuous ceiling in the cantilevered region of the contact blades 29. This latter solution reduces the risks of the terminals catching on each other when they are grouped together in bundles or when loose, and ensures complete protection of the contact blades.

Figure 3A:
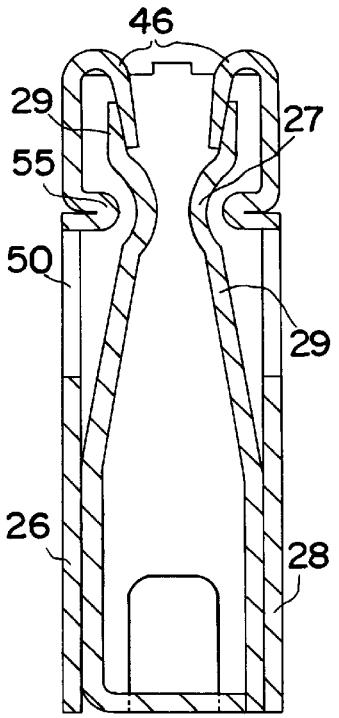
FIGS. 3A and 3B are sectional views of the front part in the form of a cage.
Figure 3B:
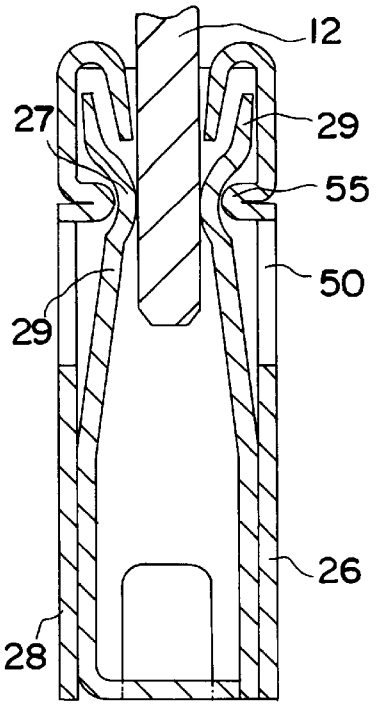
Figure 4:
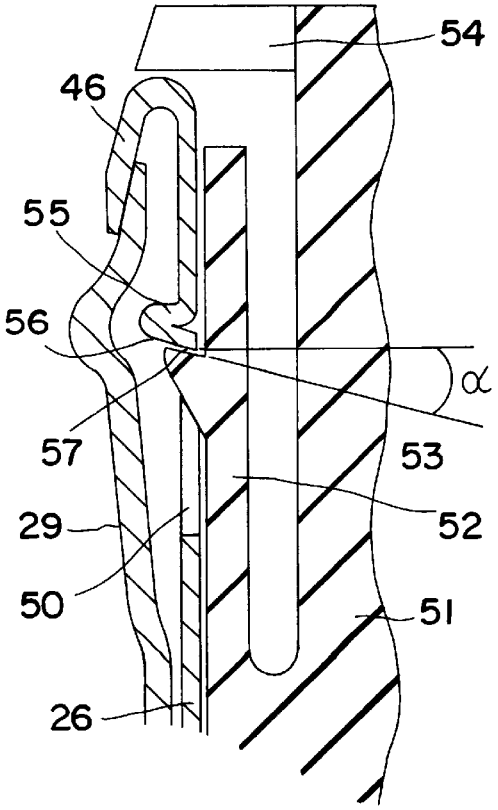
FIG. 4 is a partial section of a terminal positioned in an insulator.

Advantageously, each contact blade 29 has a shape of the kind shown in FIGS. 3 and 4. The cantilevered part, forming the electrical contact, represents somewhat more than half the total length of the internal tab 28 and is formed so as to bow inwards. In addition, it has a thickened bent part 27 facing the other contact blade, in the immediate vicinity of its free end. The elastic force due to the bowing of the contact blade 29, tending to move the two blades closer to each other, is absorbed by a flap 46, folded over towards the rear, of the corresponding external wall 26. This flap 46, which in addition enables the male contact to be guided during its insertion, thus retains the flexurally prestressed contact blade 29 in a position close to the external wall 26 to which it is linked, i.e., in a position in which it is not in contact with the other contact blade 29 which is opposite it. It may be seen in FIG. 1 that the fold of the flaps lies in front of the terminal edges of the side walls of the cage and has a rounded shape, which makes it easier to introduce the terminal into the insulator 51 of a connector housing, not shown, and reduces the risks of damaging this insulator. In order to further reduce the risk during introduction, the edges of the end and of the ceiling may be softened.

In the external walls 26, there are windows 50 intended to enable the terminal to be immobilized in an insulator 51 by means of a locking finger 52 which may have any of the constructions currently used. In the embodiment shown in FIG. 4, this finger consists of an elongate beam made during the molding of the insulator, having a projection 53 facing the inside of the cavity of the insulator and adapted to engage in the window 50. Because of the fact that the beam extends in front of the projection 53, it is possible to unlock the terminal by pushing in a tube through the front passage 54 of the insulator (delimited by an annular lip having a gap allowing the beam to be mounted), this tube sliding between the side of the terminal and the beam. Because of the symmetrical positioning of the two windows 50, the terminal may occupy one of two symmetrical positions in the cavity of the insulator.

As may be seen in FIGS. 2 to 4, the window 50 on one of its sides has a wall portion which during manufacture allows production of a deformation of the metal strip so as to form a fold 55. This fold 55 defines a shoulder whose surface 56 is intended to bear against the upper bearing surface 57 of the projection 53 enabling the terminal to be fixed in the cavity of the insulator.

It will be noted that the end of this deformation 55 faces inwards and forms a stop acting on the outer surface of the contact blade 29 so as to avoid any risk of exceeding the elastic limit of that blade.

This arrangement, combined with the arrangement described above in which the flap 46 retains a flexurally prestressed contact blade 29, thus enables the contact pressure of the blade on the male contact to be continuously controlled throughout the life of the terminal, at each insertion of the latter.

The advantage of such an arrangement is that, by virtue of the two deformations, namely the flap 46 and the fold 55, a clearance space is defined which delimits the movement of the contact blade 29 between a so-called passive position when it is retained by the flap 46 and when no male contact has been inserted and a so-called active position when it limits the maximum outward movement of the blade due to the force created by introduction of the male contact.

As may be seen in FIGS. 3A and 3B the folds 55 of the two external walls 26 converge in the same horizontal plane so that the points of contact, on the one hand, between the male contact 12 and the contact blades 29 and, on the other hand, between the contact blades 29 and the folds 55, define a space which eliminates any possibility of introducing a male contact not conforming to the dimensions of the female terminal.

As depicted in FIG. 4, the fold 55 has two orientations. The first folding operation turns part of the precut strip so as to face the center of the terminal, and than a second operation turns the same part of the strip through 180° so as to face the outside of the terminal, thus reinforcing the mechanical integrity of the shoulder formed by the fold 55. Moreover, it will be noted that the lower surface 56 of the fold 55 has a large area for bearing on the upper surface 57 of the projection 53, which avoids any risk of the sheet shearing despite the reduction in thickness of the strip. This surface 56 is substantially greater in area than the bearing surface 57, so that the force exerted on these surfaces is as uniform as possible and does not produce a cantilever.

The respective planes of the complementary bearing surfaces 56 and 57 define an angle a with the plane perpendicular to the longitudinal axis of the terminal, so that their respective opposite slopes create a self-engaging effect between the terminal and the insulator. By way of example, the value of the angle $\alpha$ of the surface 57 of the projection is between 1° and 45°, and preferably has a value of 15°.

Figure 7:
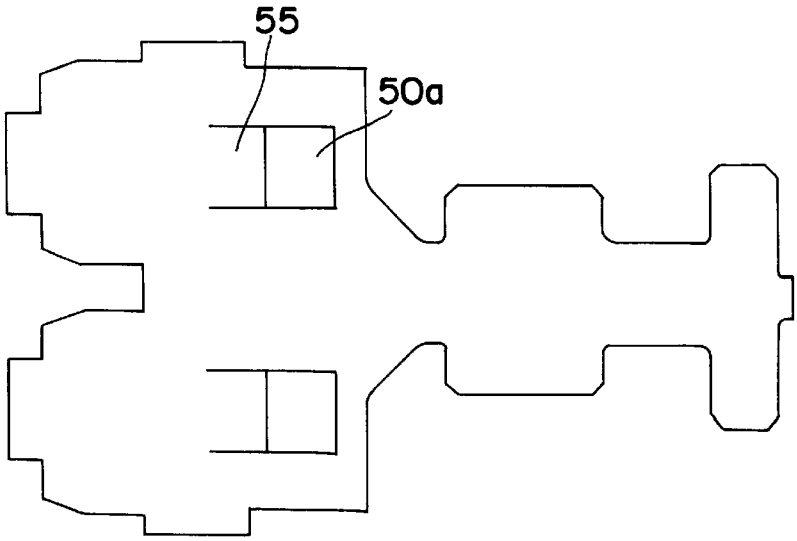
FIG. 7 PRIOR ART
FIG. 7 is a plan view of a sheet intended to be folded in order to make a terminal of the prior art.

Referring to FIG. 7, it will be noted that the windows 50*a* made in the walls of the electrical terminals of the prior art may clearly include the folds 55, although these walls are single walls.

Figure 5:
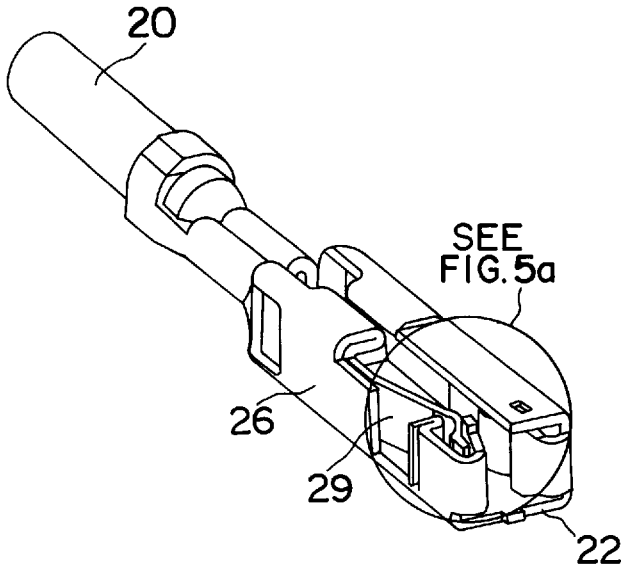
FIGS. 5 and 5A are two perspective views with a cut-away part showing the terminal in FIG. 1.
Figure 5A:
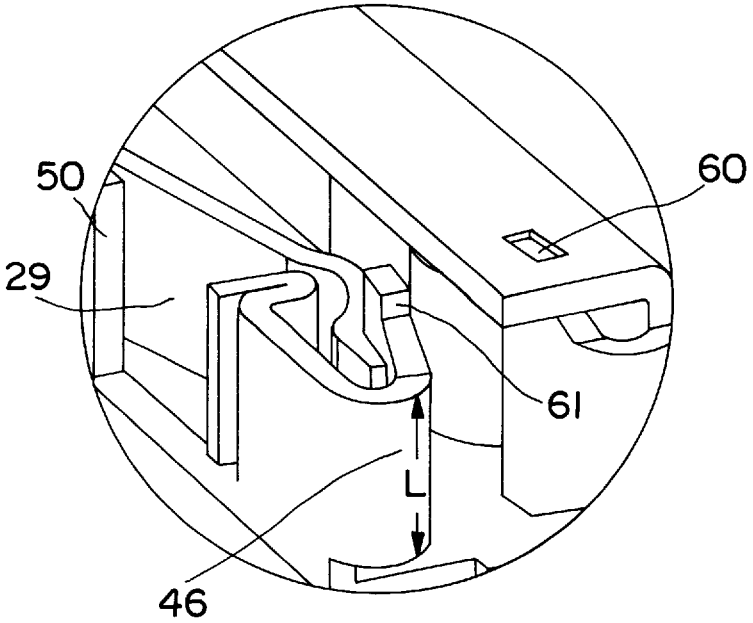

FIGS. 5 and 5A show a device for strengthening the terminal 10. Thus, for the purpose of compensating for the reduction in the thickness of the sheet, the flap 46 has a width L approximately equal to the internal width defined by the walls of the terminal once folded over so that the lateral edges of the flaps 46 come to bear on the inner surface of the end and of the upper walls of the terminal. Furthermore, these walls are provided with openings 60 into which tenons 61 made on the ends of the lateral edges of the flaps 46 engage.

Apart from the fact that the flaps 46 are thus solidly fixed, this strengthening of the cage forming the terminal 10 enables the walls of this cage to be braced and enables any accidental crushing to be avoided.

It will be noted that the flaps 46 may be fixed in the cage by a single tenon 61 provided on one of the lateral edges of the flap 46.

Figure 6:
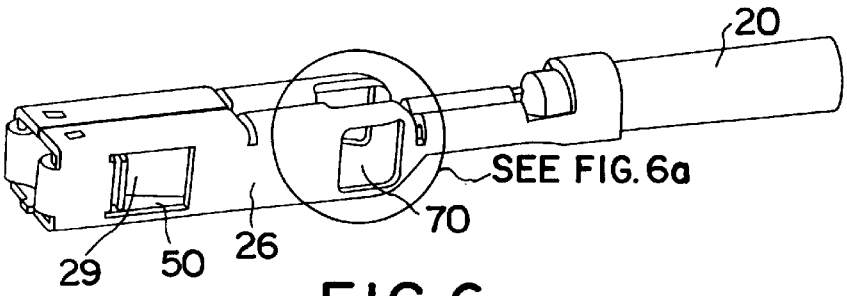
FIGS. 6 and 6A are two perspective views with a cut-away part showing another detail of the terminal in FIG. 1.
Figure 6A:
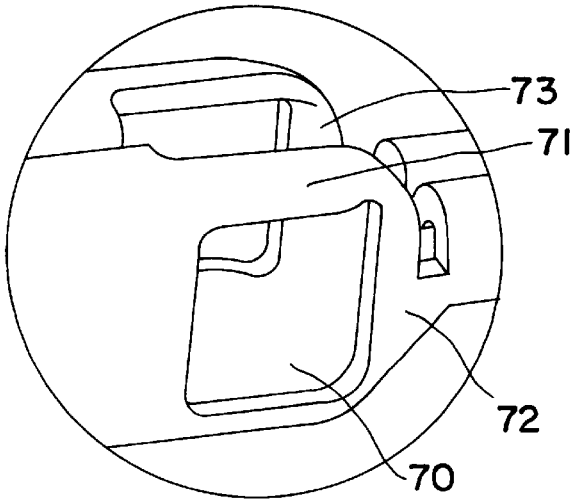

FIGS. 6 and 6A show another arrangement suitable for increasing the mechanical rigidity of the terminal in general.

In fact, between the front body 11 of the terminal 10 and the stem 14 to be crimped there is a so-called transition region 15 which may undergo deformations or misalignments prejudicial to installing the terminals in the insulators.

In these figures, it may be seen that this transition region is of smaller size. This is because the walls 26 of the front body 11 are extended by two right-angled branches 71 and 72 which with the end 22 and the wall 26, define an opening 70, thus consisting of four sides which together strengthen this partially cut-away region. It will be noted that the opening 70 allows introduction of any device for the secondary lateral locking of the terminal in a connector housing. Likewise, it should be noted that provided between the two right-angled parts, each arranged on a wall 26, is a space 73 which allows positioning of the end of any wire to be crimped which slightly exceeds the required dimensions, thus preventing this wire from pushing the terminal beyond the required standards for correct positioning of the terminal in its insulator.

A brief description will now be given of a possible process for manufacturing the terminals according to the invention, making it possible to obtain the terminals in the form of tapes for feeding a machine which automatically crimps onto wires.

In the case of the terminals of the invention which are intended for the motor-vehicle industry, the manufacture takes place by cutting and forming (folding) of strips of copper alloy having a thickness of 0.29 mm. In a first work station, the strip is cut in order to create successive sheets of the kind shown in FIG. 2, these being joined together by a connecting strip 66. The folding lines, indicated by the dot-dash lines in FIG. 2, may be marked out in a press. The contact blades 29 are shaped by bending and striking, and the flaps 46 are formed. As may be seen in FIG. 4, it is advantageous to give both the flaps and the free terminal part of the contact blades 29 a slope, for example of about 15°, which makes it easier to introduce the male contact.

The 180°-fold between the internal and external tabs and walls and the 90°-fold inwards separating the part of the internal tab belonging to the side and that belonging to the ceilings are formed; simultaneously, the tenons 61 penetrate the windows 60 and the walls formed come into contact with the edges of the flaps 46.

Many variants of the invention are possible. For example, it is possible to form a terminal whose faces are not exactly parallel but exhibit a slope; a notch allowing passage of the angled male blade, this being required for certain sealing embodiments, which is intended to receive a sealing tab may be made at the front of the ceiling of the contact.

What is claimed is:

1. A female electrical contact terminal obtained from a single electrically conducting metal sheet having a rear part enabling it to be connected to an electrical conductor and a front part in the form of a cage comprising an end, two upper half-walls, two side walls provided with means for guiding a male contact during its insertion and with means for fixing said cage in connection housings, said fixing means comprising a window in each side wall, said window being adapted to receive a projection carried by a finger provided in an insulator of the connection housing, at least one edge of said window having a deformation defining a shoulder whose bearing surface area is substantially greater than a bearing surface area of the projection.

2. The female electrical contact terminal according to claim 1, wherein the deformation consists of a fold oriented toward an inside of the terminal.

3. The female electrical contact terminal according to claim 1, wherein the deformation has a double fold extending in a first direction toward the inside of the terminal and then at 180° from said first direction.

4. The female electrical contact terminal according to claim 1, wherein the plane of the bearing surface defines with a plane perpendicular to the longitudinal axis of the terminal an angle $\alpha$ of between 1° and 45°.

5. The female electrical contact terminal according to claim 4, wherein the angle $\alpha$ has a value of 15°.

6. The female electrical contact terminal according to claim 1, wherein said window is made from an opening in said side walls, said deformation being formed by a folded flap constituted by longitudinal cuts extending said opening.

* * * * *